US006904853B2

(12) United States Patent
Chen

(10) Patent No.: US 6,904,853 B2
(45) Date of Patent: Jun. 14, 2005

(54) TAKE-UP CAM PHASE ADJUSTMENT STRUCTURE OF LOOPER THREAD TAKE-UP APPARATUS OF A SEWING MACHINE

(75) Inventor: Shih-Fang Chen, Taipei (TW)

(73) Assignee: Ching Chi Machine Co., Ltd., Taipei Hsien (TW)

( * ) Notice: Subject to any disclaimer, the term of this patent is extended or adjusted under 35 U.S.C. 154(b) by 120 days.

(21) Appl. No.: 10/657,266

(22) Filed: Sep. 9, 2003

(65) Prior Publication Data

US 2005/0051069 A1 Mar. 10, 2005

(51) Int. Cl.[7] ..... D05B 49/04
(52) U.S. Cl. ..... 112/248; 112/220
(58) Field of Search ..... 112/241, 242, 112/246, 248, 249, 250; 38/102.21; 474/113, 149, 903; 464/160, 179, 182; 403/320

(56) References Cited

U.S. PATENT DOCUMENTS 1,234,094 A * 7/1917 Drumheller ..... 112/255
1,723,195 A * 8/1929 Moffatt ..... 112/248
4,259,915 A * 4/1981 Szostak ..... 112/217.4
5,129,339 A * 7/1992 Dietl ..... 112/178
5,269,118 A * 12/1993 Bullaro ..... 53/315
5,447,019 A * 9/1995 Held et al. ..... 56/10.2 G
5,476,086 A * 12/1995 Smith ..... 124/44.5
5,676,052 A * 10/1997 Wegrzyn et al. ..... 101/127.1

* cited by examiner

*Primary Examiner*—Ismael Izaguirre
(74) *Attorney, Agent, or Firm*—Rosenberg, Klein & Lee

(57) ABSTRACT

A take-up cam phase adjustment structure of looper thread take-up apparatus of a sewing machine includes a rotary shaft rotatablly mounted in the sewing machine. A thread-guiding plate mounted on the housing for correspondingly pressing a stitching thread against the rim of the take-up cam. A transmission mechanism connected between the lower driving shaft and the rotary shaft. The transmission mechanism includes a driven wheel rotatablly mounted on the rotary shaft. The take-up cam phase adjustment structure includes a locking member for locking the driven wheel on the rotary shaft and a turning section disposed at one end of the rotary shaft. After the second locking member is unscrewed and loosened, by means of rotating the turning section, the relative radial positions between the take-up cam and the lower driving shaft is drivingly adjustable.

12 Claims, 8 Drawing Sheets

TAKE-UP CAM PHASE ADJUSTMENT STRUCTURE OF LOOPER THREAD TAKE-UP APPARATUS OF A SEWING MACHINE

BACKGROUND OF THE INVENTION

1. Field of the Invention

The present invention is related to a take-up cam phase adjustment structure of looper thread take-up apparatus of a sewing machine. A locking member (such as a screw) for locking the driven wheel on the rotary shaft is positioned on outer side of the housing of the sewing machine. After the locking member is unscrewed and loosened, the phase of the take-up cam mounted in the housing can be directly adjusted from outer side of the housing.

2. Description of the Prior Art

This applicant's U.S. patent application Ser. No. 10/303,959, filed on Nov. 26, 2002, entitled "SEWING MACHINE", now U.S. Pat. No. 6,668,739, discloses a looper thread take-up structure 23. By means of turning the looper thread take-up structure 23, the relative phase between the looper thread take-up structure 23 and the take-up cam 46 can be adjusted. In order to more conveniently adjust the relative phase between the looper thread take-up structure 23 and the take-up cam 46, the present invention provides a take-up cam phase adjustment structure of the looper thread take-up apparatus of a sewing machine. The take-up cam phase adjustment structure can be easily directly adjusted from outer side of the housing of the sewing machine.

SUMMARY OF THE INVENTION

It is therefore a primary object of the present invention to provide a take-up cam phase adjustment structure of looper thread take-up apparatus of a sewing machine. The sewing machine includes a lower driving shaft for driving a lower knotting hook. The looper thread take-up apparatus of the sewing machine includes: a rotary shaft pivotally mounted in the sewing machine; a take-up cam tightly fixed on a second end of the rotary shaft; a thread-guiding plate mounted on the housing for correspondingly pressing a stitching thread against the rim of the take-up cam; and a transmission mechanism connected between the lower driving shaft and the rotary shaft. The transmission mechanism includes a transmission wheel coupled with the lower driving shaft of the sewing machine and a driven wheel coupled with the rotary shaft. The take-up cam phase adjustment structure of the looper thread take-up apparatus of the sewing machine includes: a first locking member for locking the transmission wheel on the lower driving shaft; a second locking member for locking the driven wheel on the rotary shaft; and a turning section disposed at one end of the rotary shaft. After an operator unscrews and loosens any of the first and second locking members, by means of rotating the turning section, the relative radial positions between the take-up cam and the lower driving shaft is drivingly adjustable.

It is a further object of the present invention to provide the above take-up cam phase adjustment structure of the looper thread take-up apparatus of the sewing machine. One end of the lower driving shaft and/or a first end of the rotary shaft outward protrudes from a first sidewall of the housing of the sewing machine.

It is still a further object of the present invention to provide the above take-up cam phase adjustment structure of the looper thread take-up apparatus of the sewing machine, in which another turning section is further disposed at the other end of the rotary shaft.

It is still a further object of the present invention to provide the above take-up cam phase adjustment structure of the looper thread take-up apparatus of the sewing machine, in which the turning section is a groove.

It is still a further object of the present invention to provide the above take-up cam phase adjustment structure of the looper thread take-up apparatus of the sewing machine, in which the tuning section is a protruding plate.

The present invention can be best understood through the following description and accompanying drawings wherein:

DETAILED DESCRIPTION OF THE PREFERRED EMBODIMENTS

Figure 1:
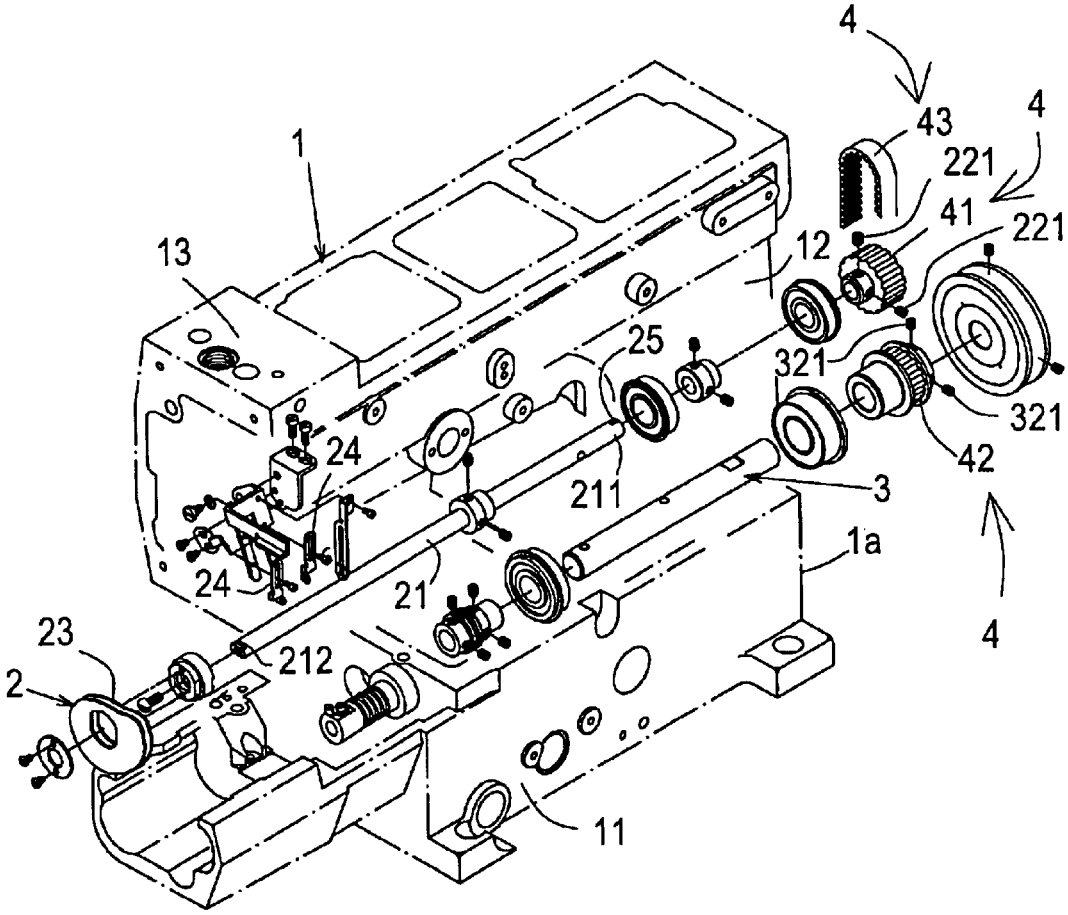
FIG. 1 is a perspective exploded view of the present invention.

Please refer to FIGS. 1 to 4. The present invention provides a take-up cam phase adjustment structure of looper thread take-up apparatus of a sewing machine. The sewing machine includes a housing 1 having a machine bed 11, a column 12 and an arm 13. A lower driving shaft 3 is disposed in the machine bed 11. One end of the lower driving shaft 3 is connected with a lower knotting hook 31. The column 12 is erectly disposed on a first side of the machine bed 11. One end of the arm 13 is connected with upper end of the column 12. The arm 13 suspensively extends from the column 12 to upper side of the second side of the machine bed 11.

Figure 2:
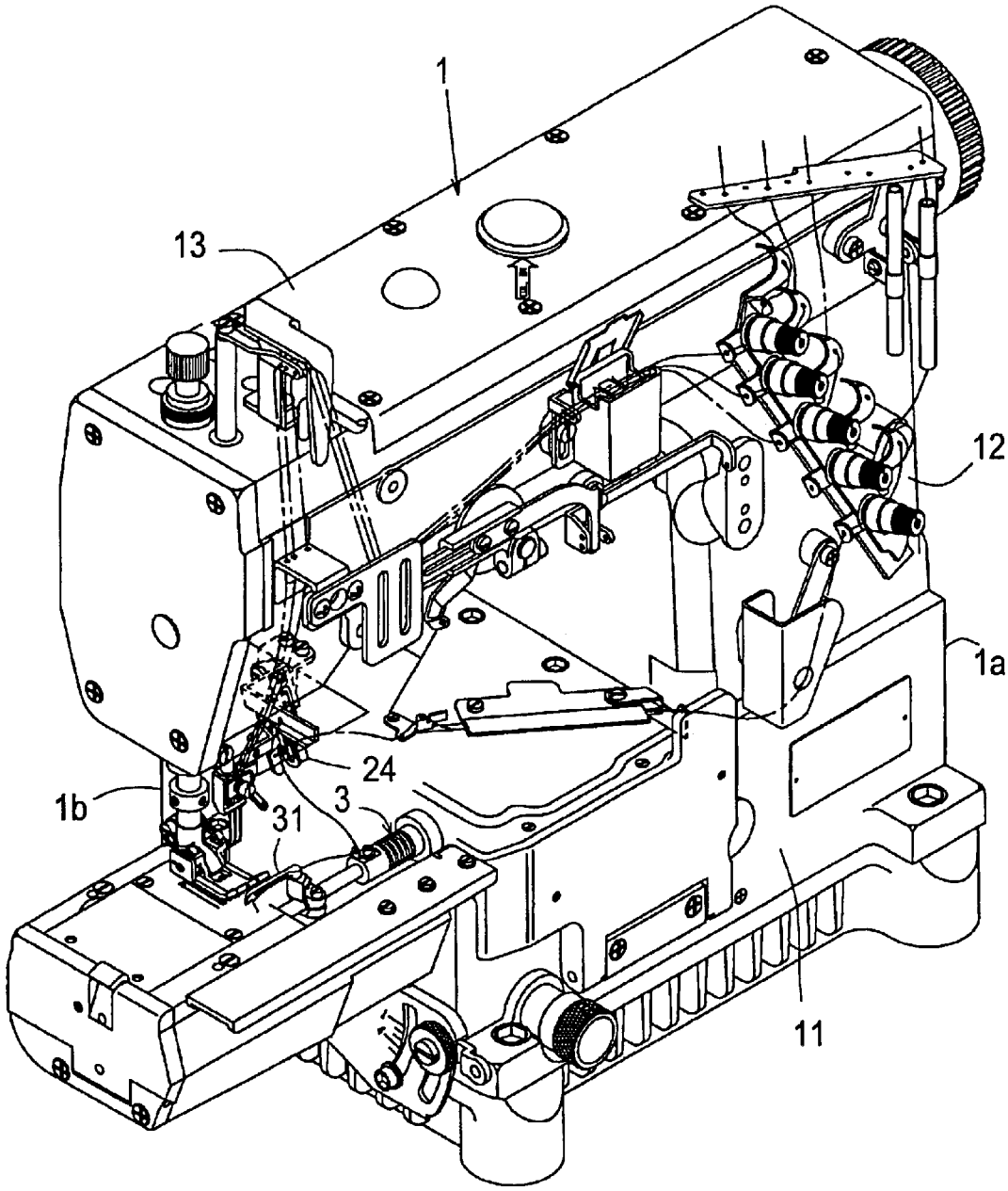
FIG. 2 is a perspective assembled view of the present invention.
Figure 3:
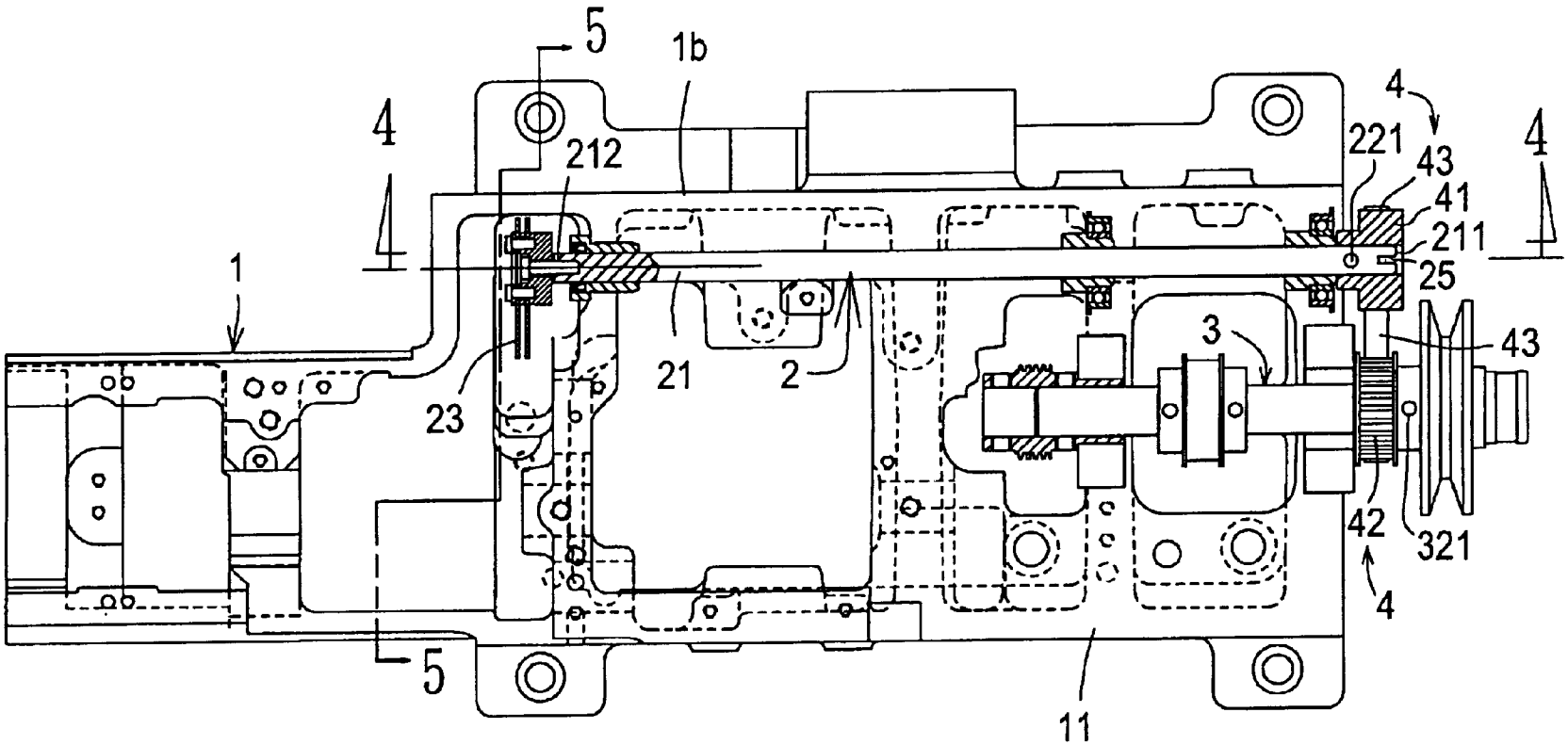
FIG. 3 is a top view of the sewing machine of the present invention.
Figure 4:
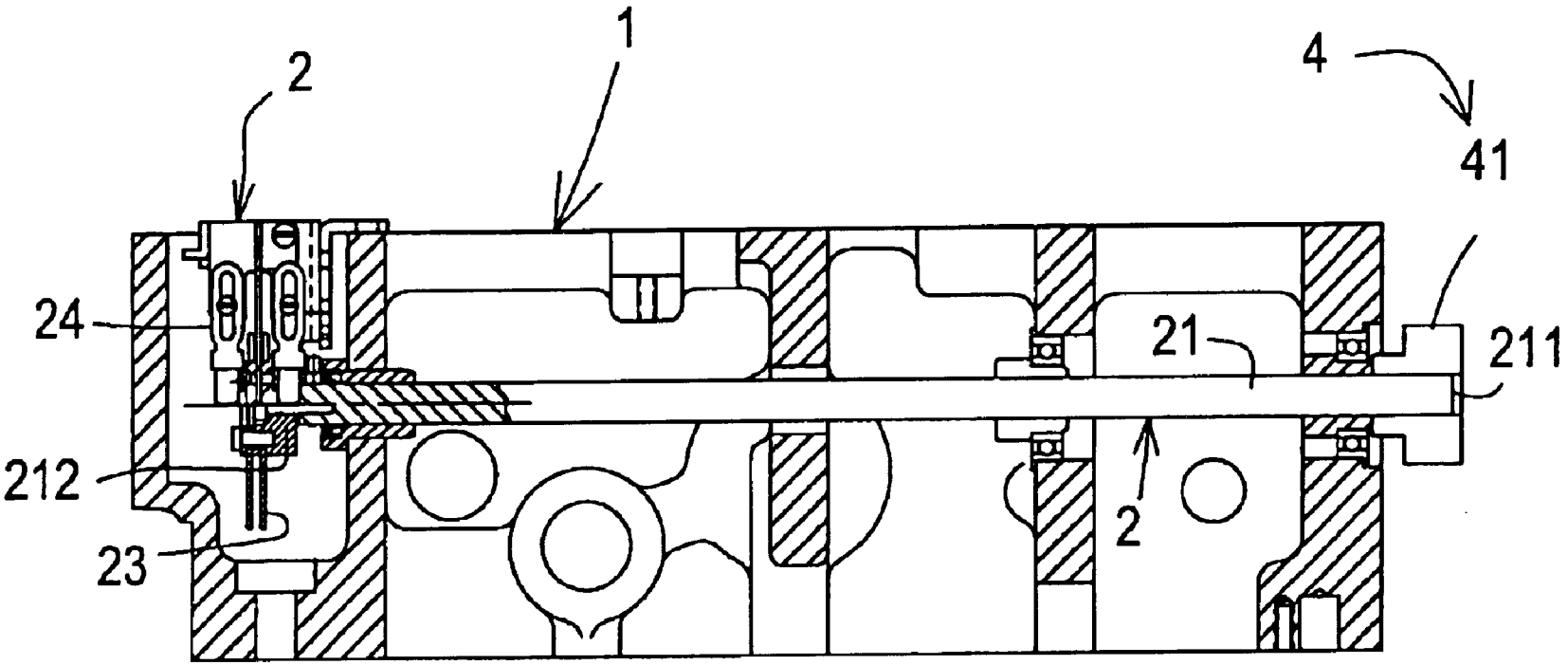
FIG. 4 is a sectional view taken along line 4—4 of FIG. 3.
Figure 5:
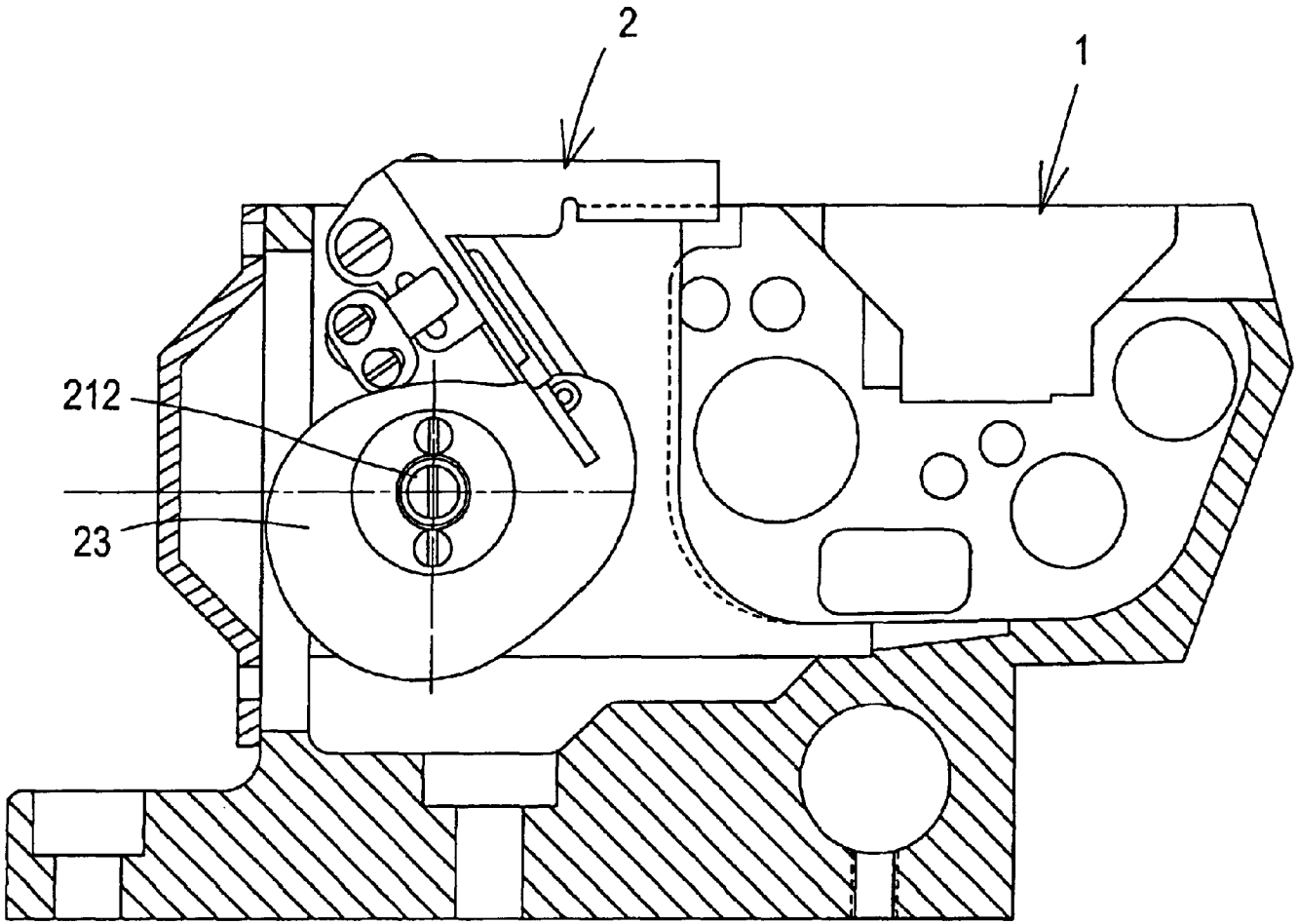
FIG. 5 is a sectional view taken along line 5—5 of FIG. 3, showing that the phase of the take-up cam has not yet been adjusted and also showing the left end face of the rotary shaft.

Referring to FIGS. 1, 2 and 3, the looper thread take-up apparatus 2 of the sewing machine includes a rotary shaft 21 pivotally mounted in the machine bed 11 of the sewing machine. A first end 211 of the rotary shaft 21 outward protrudes from a first sidewall 1*a* of the housing 1. The looper thread take-up apparatus 2 further includes a take-up cam 23 tightly fixed on a second end 212 of the rotary shaft 21. The looper thread take-up apparatus 2 further includes a thread-guiding plate 24 mounted on the housing 1 for correspondingly pressing the stitching thread against the rim of the take-up cam 23. The looper thread take-up apparatus 2 further includes a transmission mechanism 4 connected between the lower driving shaft 3 and the rotary shaft 21.

The transmission mechanism 4 includes a driven wheel 41 fitted on the first end 211 of the rotary shaft 21 and tightly locked on the rotary shaft 21 by a second locking member 221 (such as a screw). The transmission mechanism 4 further includes a transmission wheel 42 coupled with the lower driving shaft 3 of the sewing machine and a positive drive belt 43 engaged between the driven wheel 41 and the transmission wheel 42 for drivingly rotating the rotary shaft 21. The transmission mechanism 4 is not limited to the above type.

The take-up cam phase adjustment structure of the looper thread take-up apparatus of the sewing machine is characterized in that the take-up cam phase adjustment structure includes: a first locking member 321 (such as a screw) for locking the transmission wheel 42 on the lower driving shaft 3; a second locking member 221 (such as a screw) for locking the driven wheel 41 on the rotary shaft 21; and a turning section 25 disposed at any end of the rotary shaft 21 (or both ends of the rotary shaft 21). After an operator unscrews and loosens the first locking member 321 for locking the transmission wheel 42 on the lower driving shaft 3 or unscrews and loosens the second locking member 221 for locking the driven wheel 41 on the rotary shaft 21, by means of rotating the turning section 25, the relative positions between the take-up cam 23 and the lower driving shaft 3 can be drivingly adjusted to meet different requirements of sewing operation.

One end of the lower driving shaft 3 or the first end of the rotary shaft 21 outward protrudes from the first sidewall 1*a* of the housing 1. Alternatively, both the end of the lower driving shaft 3 and the first end of the rotary shaft 21 outward protrude from the first sidewall 1*a* of the housing 1.

Figure 6:
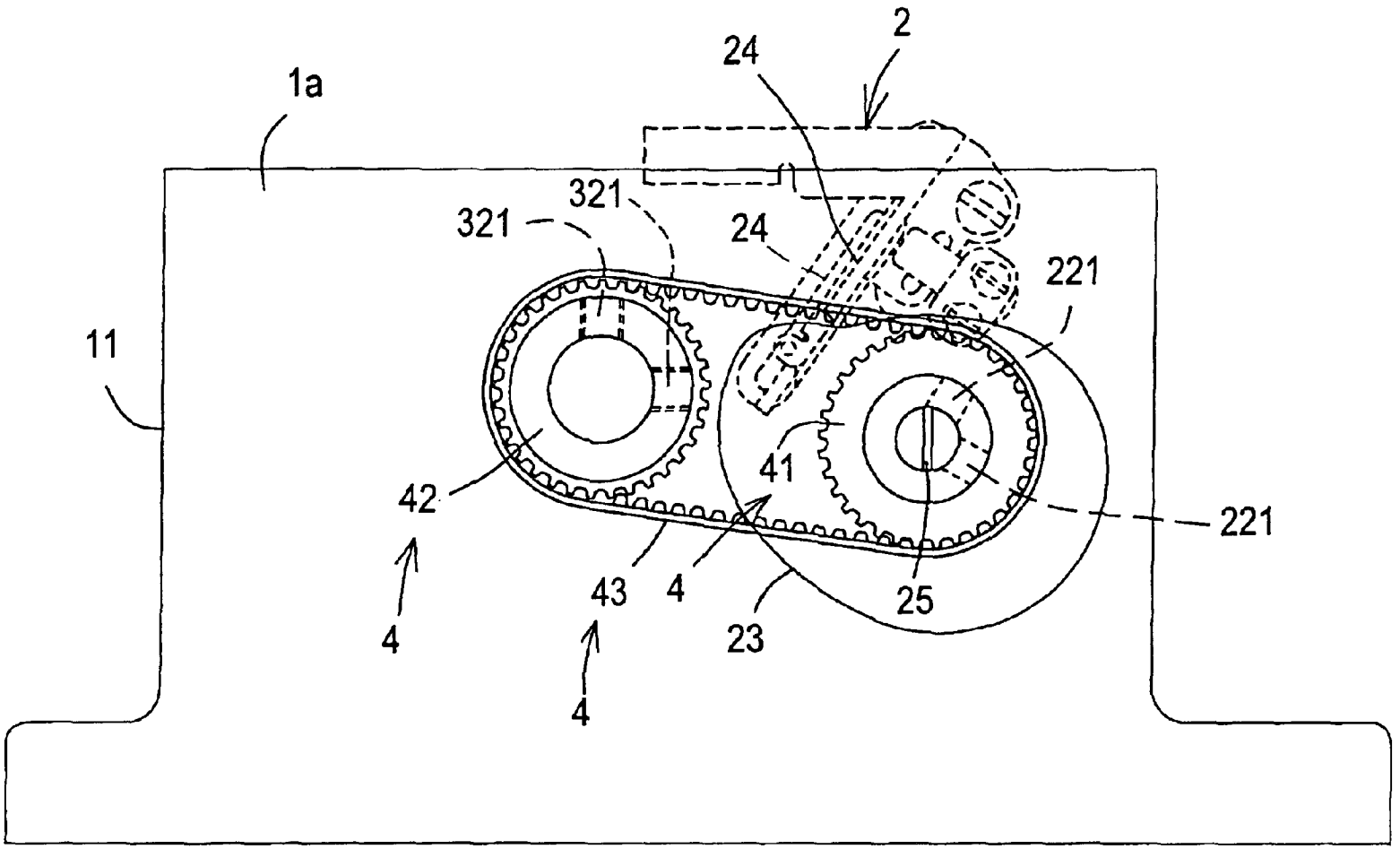
FIG. 6 is a right view according to FIG. 3, showing that the phase of the take-up cam has not yet been adjusted and also showing the right end face of the rotary shaft.
Figure 8:
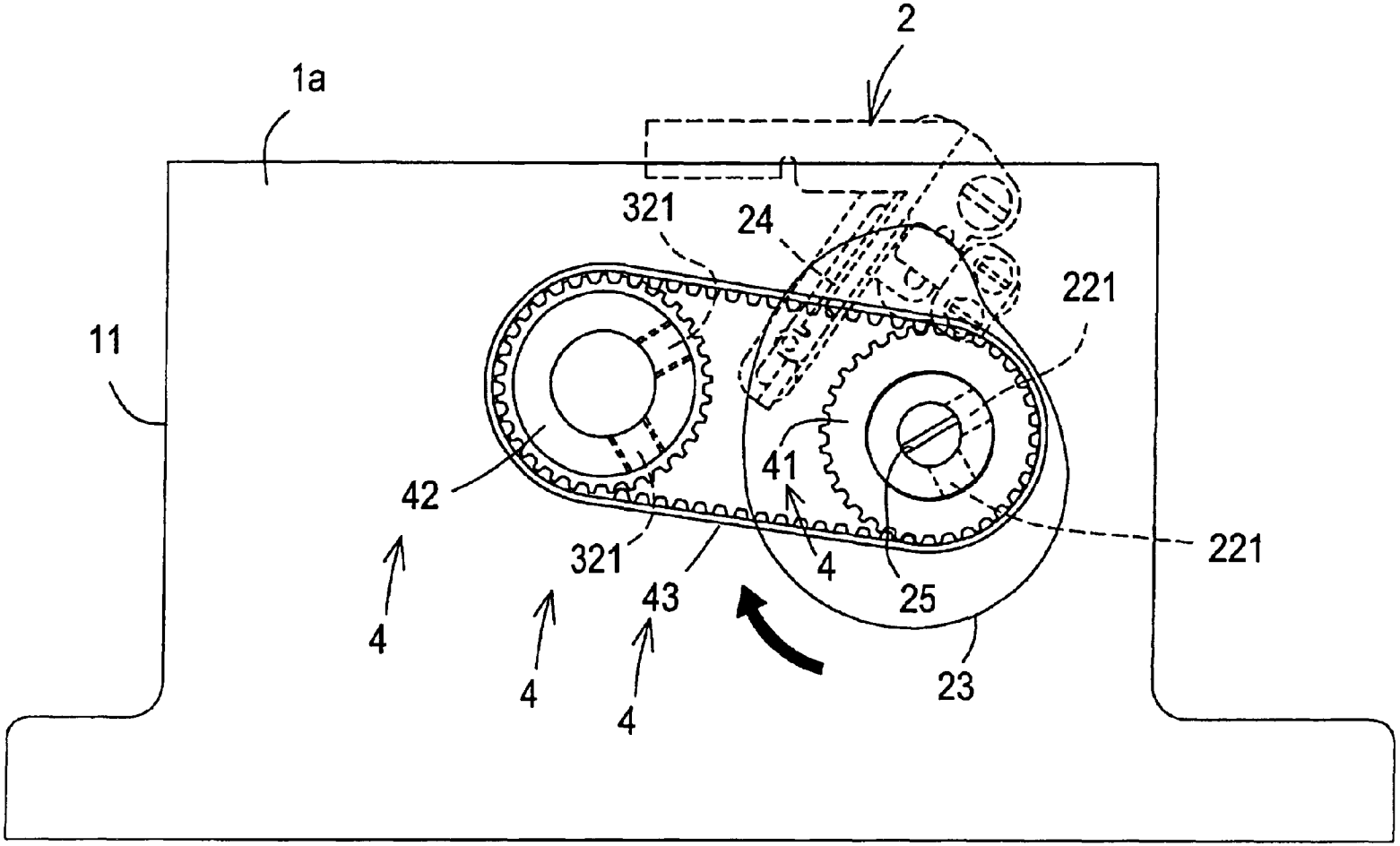
FIG. 8 is a sectional view according to FIG. 6, showing that the phase of the take-up cam has been adjusted and also showing the right end face of the rotary shaft.

Referring to FIGS. 6 and 8, the tuning section 25 can be a flat groove, cross groove or otherwise shaped groove, whereby a user can turn the rotary shaft 21 with a screwdriver or manually. Alternatively, the turning section 25 can be a protruding plate for a user to manually turn the rotary shaft 21. This is not limited.

Figure 7:
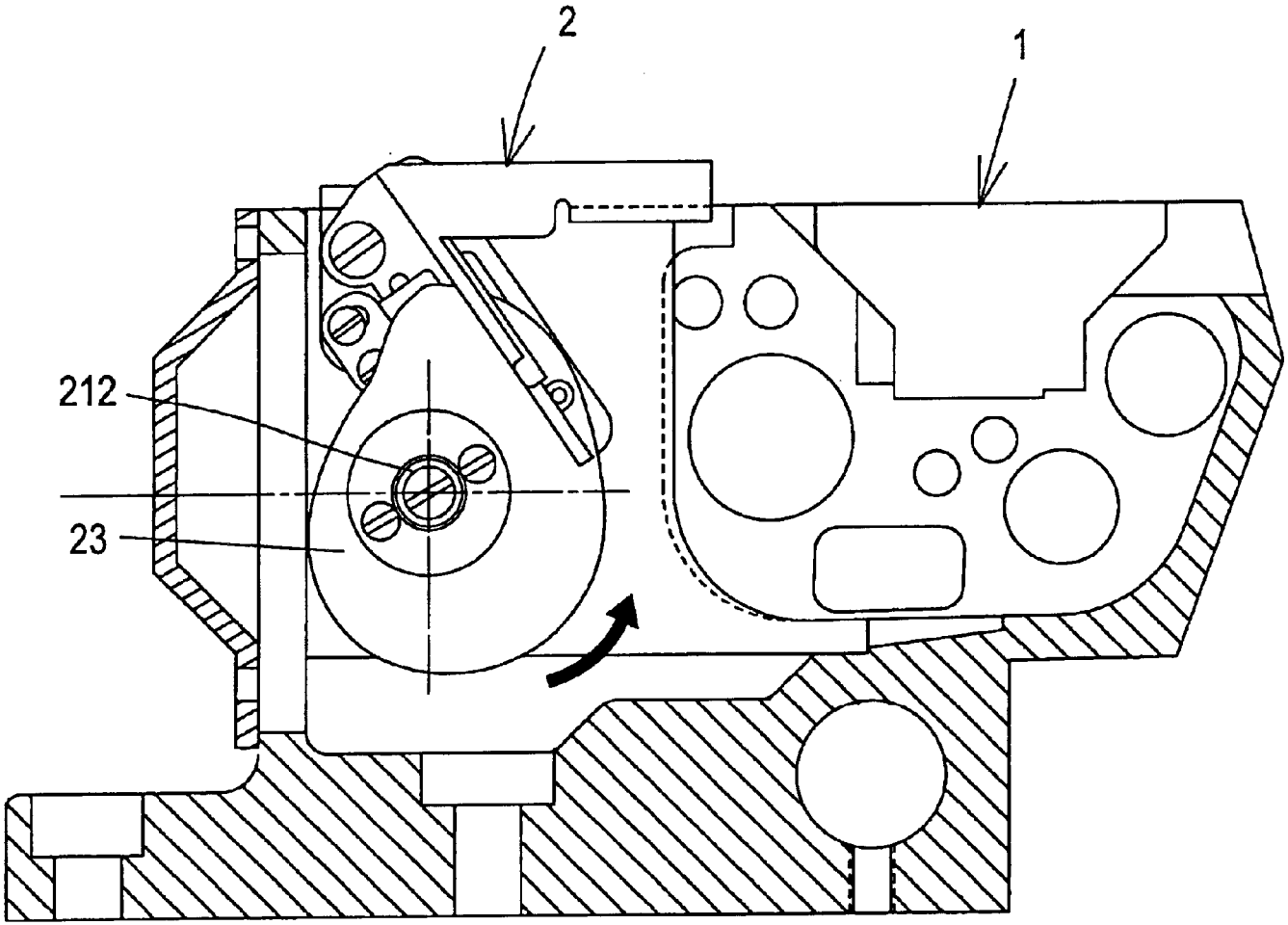
FIG. 7 is a sectional view according to FIG. 5, showing that the phase of the take-up cam has been adjusted and also showing the left end face of the rotary shaft.

Referring to FIGS. 2 and 6, when adjusting the phase of the take-up cam 23, the second locking member 221 for locking the driven wheel 41 on the rotary shaft 21 or the first locking member 321 for locking the transmission wheel 42 on the lower driving shaft 3 can be directly unscrewed and loosened from outer side of the housing 1 of the sewing machine. Thereafter, the operator can fit a tool (such as a screwdriver) with the turning section 25 at one end of the rotary shaft 21 to turn the same. Accordingly, the rotary shaft 21 is freely rotated within the shaft hole of the driven wheel 41. At the same time, the take-up cam 23 is rotated along with the rotary shaft 21 so that the phase of the take-up cam 23 is adjusted. FIGS. 7 and 8 show the take-up cam after adjusted. The driven wheel 41 is not drivingly rotated so that the lower driving shaft 3 and the lower knotting hook 31 are not driven. Therefore, the operator can easily turn and adjust the take-up cam 23 to a predetermined phase. After adjusted, the operator only needs to screw and tighten the second locking member 221 for locking the driven wheel 41 on the rotary shaft 21. At this time, the adjustment of the phase of the take-up cam is completed.

According to the above arrangement, the operator can directly adjust the phase of the take-up cam from outer side of the housing of the sewing machine without disassembling the housing. Therefore, the adjustment of the phase of the take-up cam is facilitated and speeded.

The above embodiments are only used to illustrate the present invention, not intended to limit the scope thereof. Many modifications of the above embodiments can be made without departing from the spirit of the present invention.

What is claimed is:

1. A take-up cam phase adjustment structure of looper thread take-up apparatus of a sewing machine, the sewing machine comprising a lower driving shaft for driving a lower knotting hook, the looper thread take-up apparatus of the sewing machine comprising:

(a) a rotary shaft pivotally mounted in the sewing machine;

(b) a take-up cam tightly fixed on a second end of the rotary shaft;

(c) a thread-guiding plate mounted on the housing for correspondingly pressing a stitching thread against the rim of the take-up cam; and (d) a transmission mechanism connected between the lower driving shaft and the rotary shaft, the transmission mechanism comprising a transmission wheel coupled with the lower driving shaft of the sewing machine and a driven wheel coupled with the rotary shaft, the take-up cam phase adjustment structure of the looper thread take-up apparatus of the sewing machine comprising: a first locking member for locking the transmission wheel on the lower driving shaft; a second locking member for locking the driven wheel on the rotary shaft; and a turning section disposed at one end of the rotary shaft, whereby after an operator unscrews and loosens any of the first and second locking members, by means of rotating the turning section, the relative radial positions between the take-up cam and the lower driving shaft is drivingly adjustable.

2. The take-up cam phase adjustment structure of the looper thread take-up apparatus of the sewing machine as claimed in claim 1, wherein another turning section is further disposed at the other end of the rotary shaft.

3. The take-up cam phase adjustment structure of the looper thread take-up apparatus of the sewing machine as claimed in claim 1, wherein the turning section is a groove.

4. The take-up cam phase adjustment structure of the looper thread take-up apparatus of the sewing machine as claimed in claim 1, wherein the turning section is a protruding plate.

5. A take-up cam phase adjustment structure of looper thread take-up apparatus of a sewing machine, the sewing machine comprising a lower driving shaft for driving a lower knotting hook, the looper thread take-up apparatus of the sewing machine comprising:

(a) a rotary shaft pivotally mounted in the sewing machine;

(b) a take-up cam tightly fixed on a second end of the rotary shaft;

(c) a thread-guiding plate mounted on the housing for correspondingly pressing a stitching thread against the rim of the take-up cam; and (d) a transmission mechanism connected between the lower driving shaft and the rotary shaft, the transmission mechanism comprising a transmission wheel coupled with the lower driving shaft of the sewing machine and a driven wheel coupled with the rotary shaft, the take-up cam phase adjustment structure being characterized in that a first end of the rotary shaft outward protrudes from a first sidewall of the housing of the sewing machine, the take-up cam phase adjustment structure of the looper thread take-up apparatus of the sewing machine comprising: a first locking member for locking the transmission wheel on the lower driving shaft; a second locking member for locking the driven wheel on the rotary shaft; and a turning section disposed at one end of the rotary shaft, whereby after an operator unscrews and loosens the second locking member, by means of rotating the turning section, the relative radial positions between the take-up cam and the lower driving shaft is drivingly adjustable.

6. The take-up cam phase adjustment structure of the looper thread take-up apparatus of the sewing machine as claimed in claim 5, wherein another turning section is further disposed at the other end of the rotary shaft.

7. The take-up cam phase adjustment structure of the looper thread take-up apparatus of the sewing machine as claimed in claim 5, wherein the turning section is a groove.

8. The take-up cam phase adjustment structure of the looper thread take-up apparatus of the sewing machine as claimed in claim 5, wherein the turning section is a protruding plate.

9. A take-up cam phase adjustment structure of looper thread take-up apparatus of a sewing machine, the sewing machine comprising a lower driving shaft for driving a lower knotting hook, the looper thread take-up apparatus of the sewing machine comprising:

(a) a rotary shaft pivotally mounted in the sewing machine;

(b) a take-up cam tightly fixed on a second end of the rotary shaft;

(c) a thread-guiding plate mounted on the housing for correspondingly pressing a stitching thread against the rim of the take-up cam; and (d) a transmission mechanism connected between the lower driving shaft and the rotary shaft, the transmission mechanism comprising a transmission wheel coupled with the lower driving shaft of the sewing machine and a driven wheel coupled with the rotary shaft, the take-up cam phase adjustment structure being characterized in that the take-up cam phase adjustment structure of the looper thread take-up apparatus of the sewing machine comprising: a locking member for locking the driven wheel on the rotary shaft; and a turning section disposed at one end of the rotary shaft, whereby after an operator unscrews and loosens any of the first and second locking members, by means of rotating the turning section, the relative radial positions between the take-up cam and the lower driving shaft is drivingly adjustable.

10. The take-up cam phase adjustment structure of the looper thread take-up apparatus of the sewing machine as claimed in claim 9, wherein another turning section is further disposed at the other end of the rotary shaft.

11. The take-up cam phase adjustment structure of the looper thread take-up apparatus of the sewing machine as claimed in claim 9, wherein the turning section is a groove.

12. The take-up cam phase adjustment structure of the looper thread take-up apparatus of the sewing machine as claimed in claim 9, wherein the turning section is a protruding plate.

* * * * *